US005120054A

United States Patent [19]

Wetzel

[11] Patent Number: 5,120,054

[45] Date of Patent: Jun. 9, 1992

[54] PROTECTED BUMPER STRUCTURE FOR BASKETBALL BACKBOARD

[75] Inventor: Dan R. Wetzel, Lake Stevens, Wash.

[73] Assignee: Basketball Product International, Everett, Wash.

[21] Appl. No.: 640,702

[22] Filed: Jan. 14, 1991

[51] Int. Cl.[5] ..... A63B 63/08

[52] U.S. Cl. ..... 273/1.5 R

[58] Field of Search ..... 273/1.5 R, 55 D; 272/63, 62; 267/400; D21/201

[56] References Cited

U.S. PATENT DOCUMENTS

| | | | |
|---|---|---|---|
| 3,958,801 | 5/1976 | Correa | 273/55 D X |
| 4,424,968 | 1/1984 | Smith | 273/1.5 R |
| 4,650,188 | 3/1987 | Schroeder | 273/1.5 R |
| 4,739,988 | 4/1988 | Schroeder | 273/1.5 R |
| 4,988,138 | 1/1991 | Danna et al. | 293/120 X |

OTHER PUBLICATIONS

1989 School Mail Order Catalog, Korney Board Aids, Basketball Coaching and Training Aids, Dec. 1988, p. 32 Cushion-Edge Protective Padding.

Porter Athletic Co. Advertising Circular Sep. 1984 From 1985 Sweet's Catalog File Chapter 11.15 PO.

Sports Illustrated Apr. 1988.

Adams Plastics, Inc., Sale Literature, dated 28 Jan. 1980.

Atheletic Equipment, Inc., Sales Literature, San Pedro, CA.

Gared Company Athletic Equipment, Inc., Sales Literature, St. Louis, MO.

GSC Athletic Equipment, Inc., Sales Literature, San Pedro, CA.

*Primary Examiner*—Paul E. Shapiro

*Attorney, Agent, or Firm*—Hughes & Multer

[57] ABSTRACT

A protected backboard bumper structure for cushioning the lower edges of basketball backboards. A stretchable cover is placed around a bumper pad. The lower edges of the basketball backboard are received within a groove on the bumper pad. With the lower edges of the backboard received within the groove, the cover is stretched into the groove and held between the backboard and the bumper pad.

10 Claims, 3 Drawing Sheets

FIG. 1
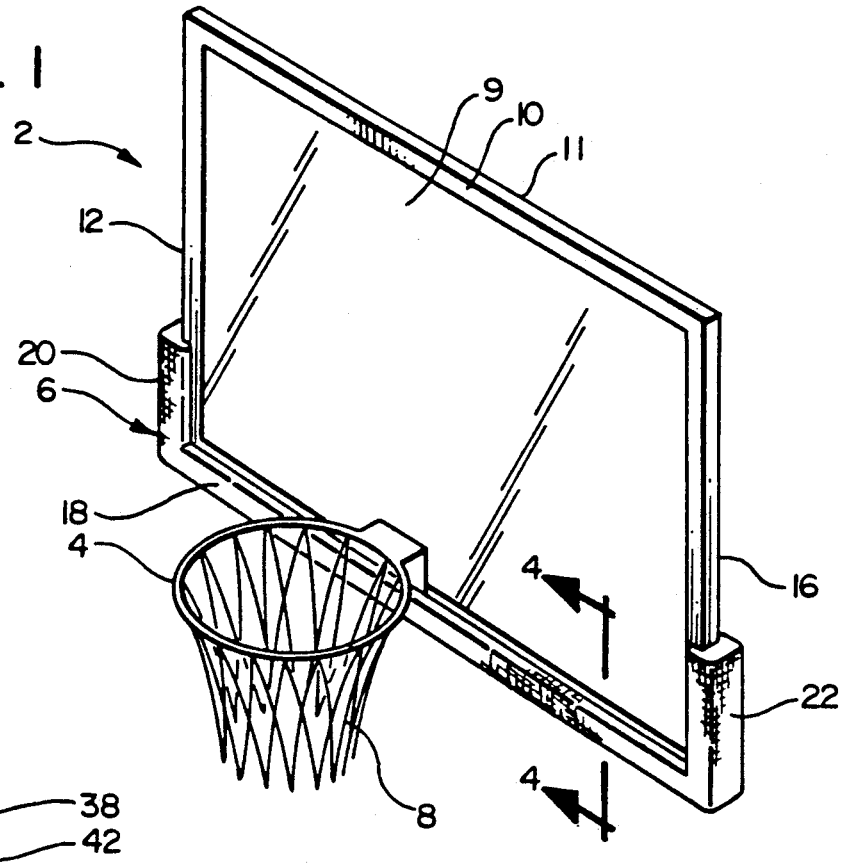
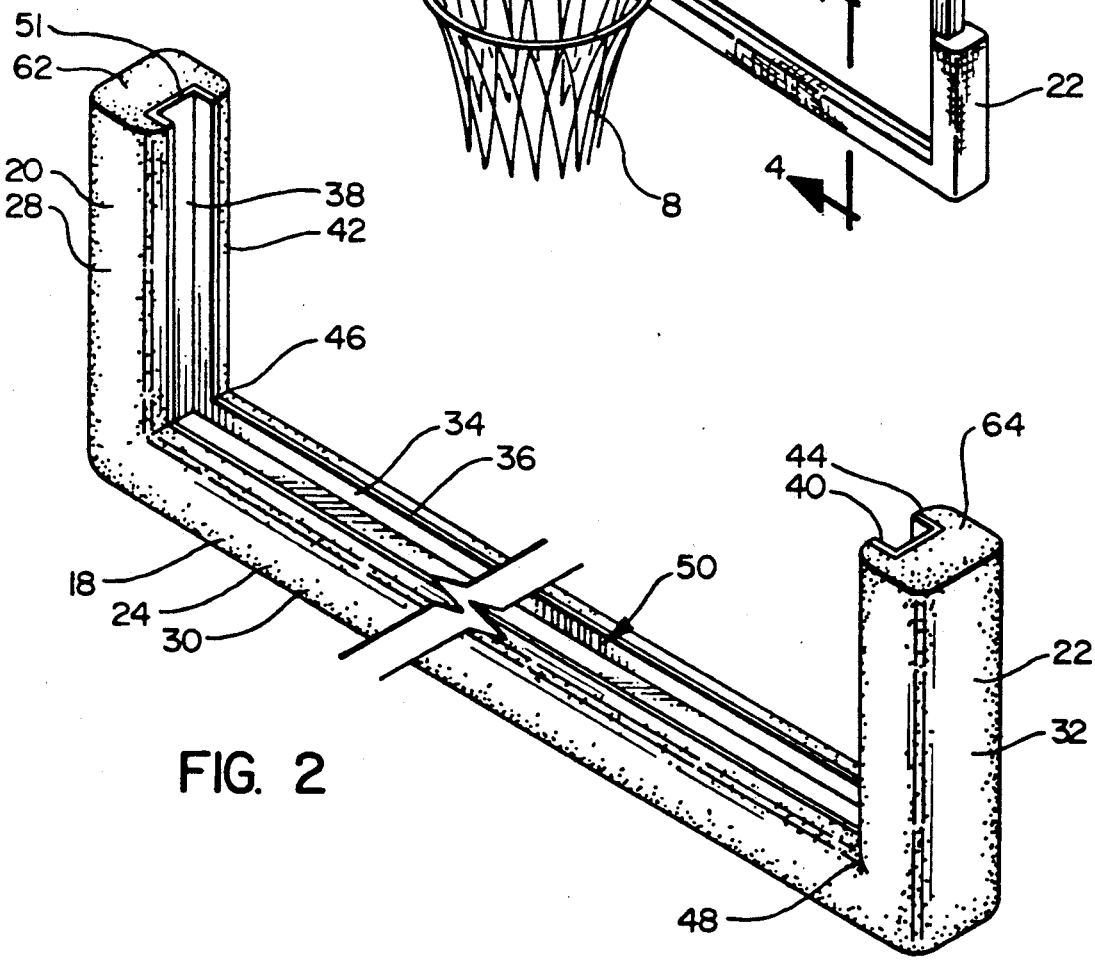
FIG. 2

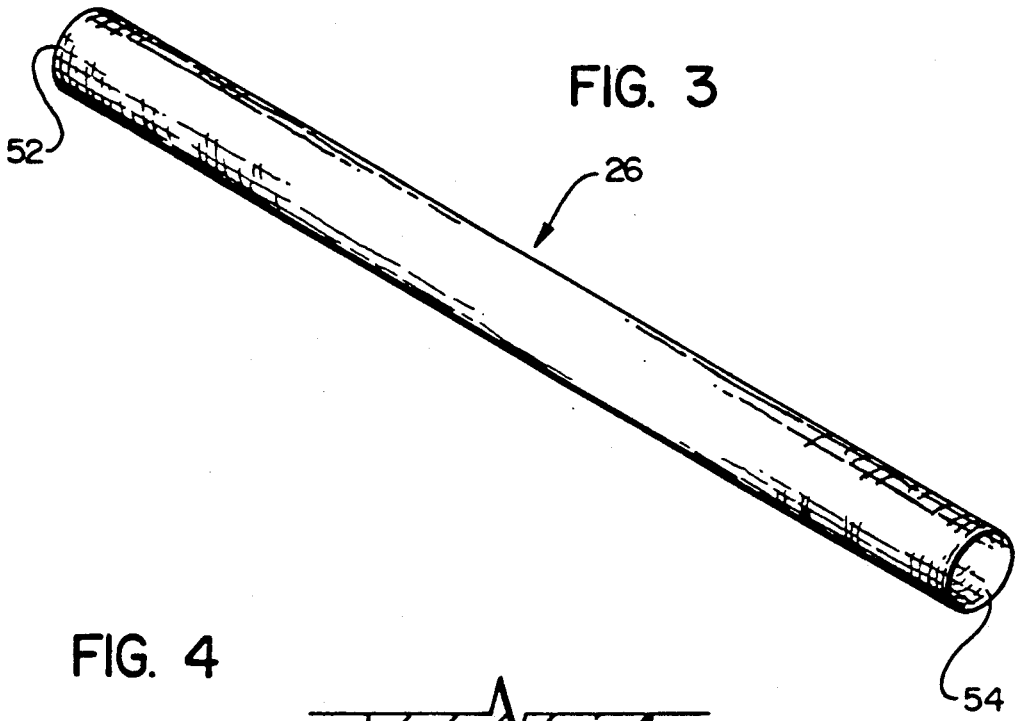
FIG. 3
FIG. 4
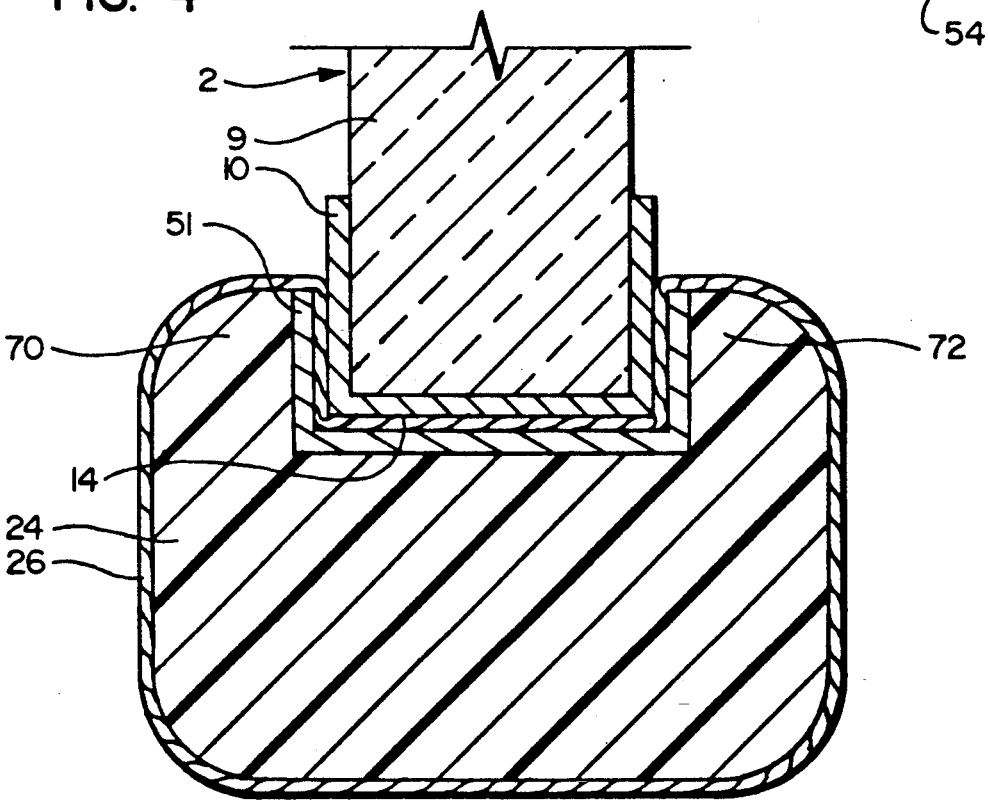

2
9
10
16
12
74
76
14
56
62
58
64
6
60
42
36
50
44
32
28
52
24
30
26
54
ℓ

62
24
52
26

64
54
66
6
68

PROTECTED BUMPER STRUCTURE FOR BASKETBALL BACKBOARD

FIELD OF THE INVENTION

The present invention relates to athletic equipment and, more specifically, to basketball backboards having bumper pads covering the bottom edges thereof.

BACKGROUND OF THE INVENTION

Bumper pads are often used to cushion the bottom and lower side edges of basketball backboards. The purpose of the bumper pads is to protect a basketball player from injuries. Such injuries may occur when a player's head, hand, or arm strikes the edge of the backboard.

The bumper pads are made of a soft, resilient closed cell rubber material and are designed to absorb the impact between a basketball player and the backboard.

Because the material from which the bumper pads are made is soft, bumper pads are susceptible to scratches and tears caused by the impact of basketball players and basketballs thereon. Further, bumper pads are susceptible to scuffing and discoloration over time.

When bumper pads become sufficiently scratched, torn, scuffed, or discolored, they must be replaced at relatively high cost.

Further, the process of manufacturing and system of distributing such bumper pads is not conducive to custom coloring of the bumper pads.

OBJECTS OF THE INVENTION

From the foregoing, it is apparent that the provision of a novel, improved backboard bumper pad is one primary and important object of the present invention.

Other, also important, but more specific objects of the invention include the provision of a protected backboard bumper structure that:

(a) is resistant to scratches, tears, and discoloration;

(b) may easily and inexpensively be repaired;

(c) may be inexpensively color coordinated with the colors of the school or institution that owns the backboard to be cushioned;

(d) is cheaply manufactured; and (e) is easily adapted to existing backboards and bumper pads.

SUMMARY OF THE INVENTION

Disclosed herein is a new and novel protected backboard bumper structure that does not contain the above-discussed, or other, disadvantages of heretofore proposed backboard bumpers.

Generally speaking, the novel protected backboard bumper structure includes a backboard bumper pad and a stretchable cover that is placed over the bumper pad. The bumper pad has a groove formed thereon for receiving the bottom and lower side edges of the backboard. With the edges of the backboard so received within the groove, the cover is stretched into the groove and held between the backboard and the bumper pad.

The dimensions of the cover are determined by: (a) the material from which the cover is made; and (b) the dimensions of the bumper pad.

BRIEF DESCRIPTION OF THE DRAWINGS

FIG. 1 is a perspective view of a basketball backboard cushioned by a protected backboard bumper structure constructed in accordance with, and embodying, the principles of the present invention.

FIG. 2 is a perspective view of a bumper pad of the protected bumper structure.

FIG. 3 is a perspective view of a cover of the protected bumper structure.

FIG. 4 is a cut-away view taken along arrows 4 in FIG. 1.

DETAILED DESCRIPTION OF THE INVENTION

Figure 5:
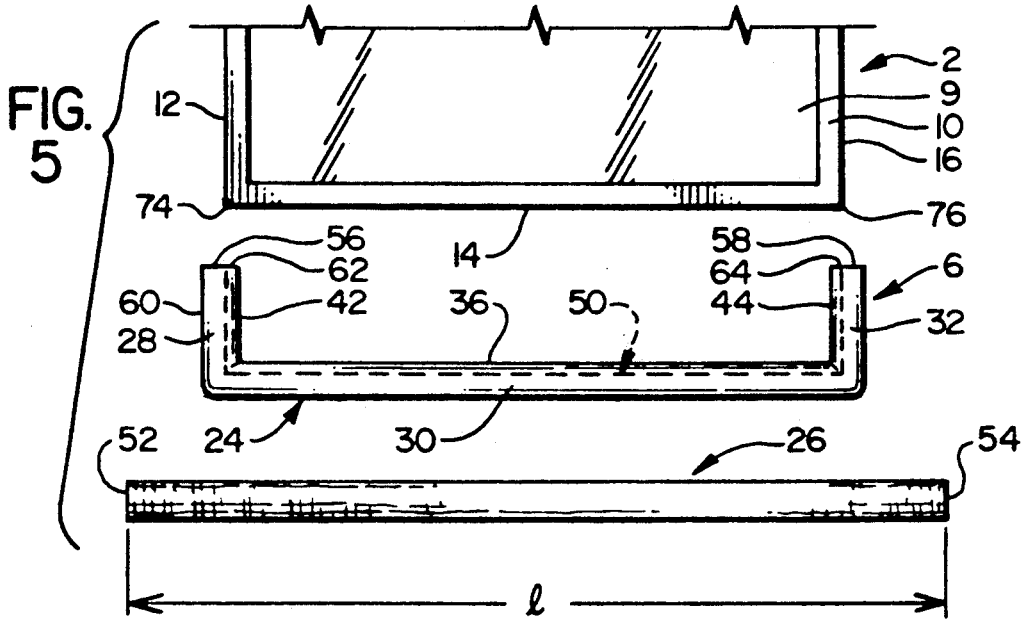
FIG. 5 is a front view of the present invention depicting the relationship of the dimensions of the backboard, bumper pad, and cover.
Figure 6:
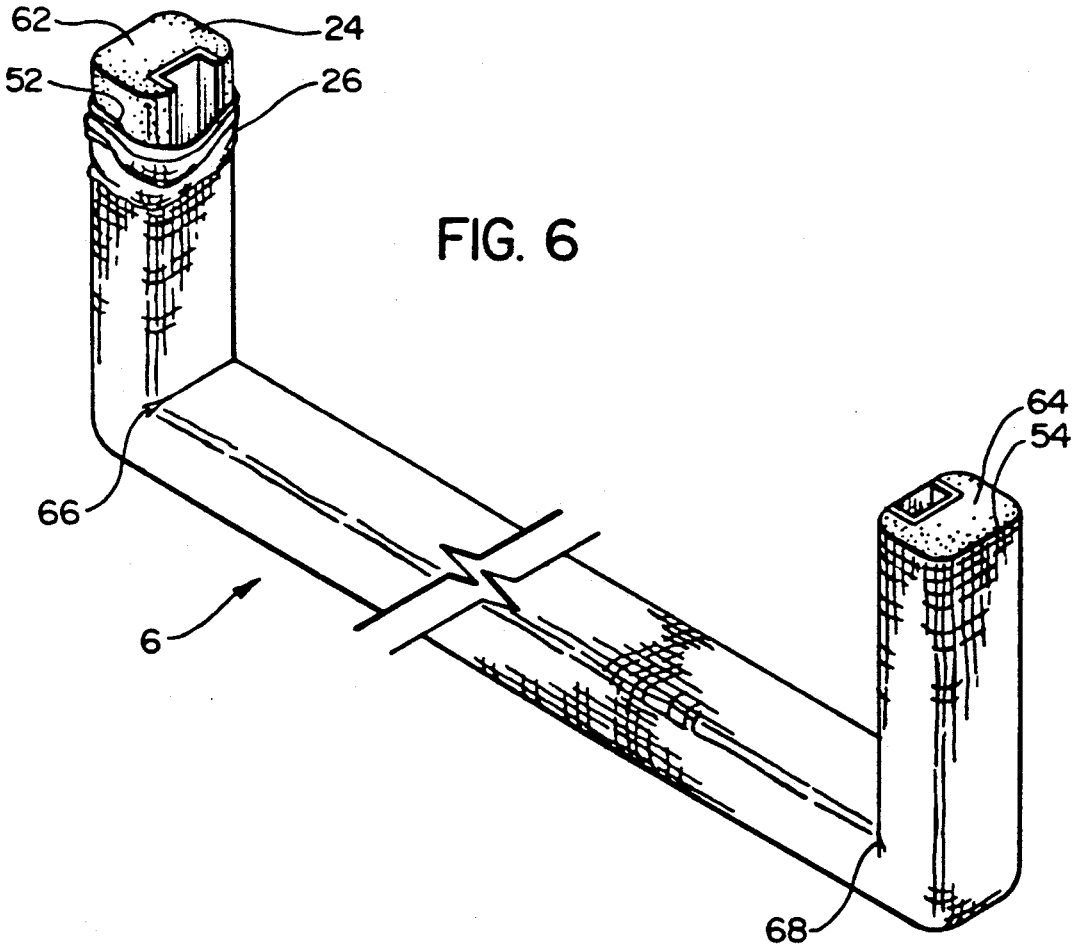
FIG. 6 is a perspective view of protected bumper structure of the present invention.

Referring now to the drawing, FIG. 1 depicts a backboard structure 2 with a rim 4 extending therefrom and a protected backboard bumper structure 6 assembled in accordance with, and embodying, the principles of the present invention. A net 8 hangs from rim 4.

Backboard structure 2 is rectangular and comprises a backboard 9 and a peripheral steel frame 10 folded around top edge 11, left side edge 12, bottom edge 14 (FIG. 5), and right side edge 16 of backboard 9.

Protected bumper structure 6 includes a middle section 18 and left and right end sections 20 and 22. Bumper sections 18, 20 and 22 cover bottom edge 14 and partially cover left and right edges 12 and 16 of the backboard structure 2 when the protected bumper structure 6 is attached to the backboard structure 2.

Protected backboard bumper 6 comprises a bumper pad 24 (FIG. 2) and a cover 26 (FIG. 3). The bumper pad 24 is resilient and comprises three main sections: a left end section 28, a middle section 30, and a right end section 32. More specifically, the left end, right end, and middle sections are formed from separate pieces. Left and right end sections 28 and 32 extend upwardly at right angles to middle section 30. Miterd joints are formed at the connections between the end sections 28 and 32 and the middle section 30. A groove 34 is formed on upper surface 36 of the center portion 30. Similar grooves 38 and 40 are formed on inner surfaces 42 and 44 of end portions 28 and 32, respectively. Grooves 36, 38, and 40 are joined at corners 46 and 48 to form one continuous, generally U-shaped groove 50.

Cover 26 in the preferred embodiment is a thin, elongate tube-shaped piece of stretchable material. The stretchable material is preferably an interlocked knit material. Cover 26 has open ends 56 and 54.

The dimensions of cover 26 are determined by several criteria. The length of cover 26 is determined by the lengths of the outside surfaces of sections 28, 30, and 32 of bumper pad 24. As shown in FIG. 5, the length 1 of cover 26 is substantially equal to the total lengths of the outside surfaces of section 28, 30, and 32. If the length 1 of cover 26 is less than this total length, a portion of bumper 28 will be exposed when the cover 26 is placed over bumper pad 24 as discussed in further detail below. Further, if the length 1 of the cover 26 is greater than this total length, end 52 and/or end 54 of the cover 26 would undesirably extend past distal ends 56 and 58 of bumper pad 24.

The distance around the cross-sectional perimeter of unstretched cover 26 is determined based on: (a) the amount of stretch of the material from which the cover 26 is made; and (b) the length of the cross-sectional perimeter of bumper pad 24 (FIG. 4). More specifically, the length of the cross-sectional perimeter of cover 26 when fully stretched should be greater than the length of the cross-sectional perimeter of bumper pad 24. "Fully stretched" as used herein is the amount that the material form which cover 26 is made can be stretched without tearing.

In the preferred embodiment, the length of cover 26 is between 106 and 109 inches, and is preferably 108 inches. The distance around the cross-sectional perimeter of unstretched cover 26 is between 9 and 11 inches, and is preferably 10 inches. These dimensions were calculated for: (a) a bumper pad 24 whose cross-sectional perimeter length is 14 inches and whose total length of its outer surface is 108 inches; and (b) a cover 26 made from interlock knit material made of cotton and lycra.

To assemble the cover 26 and the bumper pad 24 together, an end 62 of the bumper pad 24 is inserted into the end 54 of the cover 26. The bumper pad 24 is inserted through cover 26 until the end 54 of the cover 26 reaches the end 64 of the bumper pad 24. The bumper pad 24 is therefore completely covered except for the upper surfaces of the ends 62 and 64 thereof.

With the bumper pad 24 and the cover 26 so assembled into protected bumper structure 6, folds 66 and 68 are created at corners 46 and 48, respectively. These folds are created because the total length of surfaces 36, 42, and 44 is shorter than the length of the cover 26 (FIG. 4).

Groove 50 is designed to receive the lower portion of backboard structure 2. More specifically, bottom edge 14 is received within groove 34 and the bottoms of side edges 12 and 16 are received within grooves 38 and 40, respectively. Because the cover 26 has been placed around the bumper pad 24, the edges of the backboard structure 2 force the cover 26 into the groove 50 when the edges are received within the groove (FIG. 4). As the edges enter the groove 50, the cover 26 stretches until its cross-sectional perimeter conforms to the cross-sectional perimeter of bumper pad 24.

The groove 50 must expand slightly to accommodate the edges of backboard structure 2. Because bumper pad 24 and steel frame 10 are resilient, backboard structure 2 and cover 26 are pinched between the front sections 70 and back sections 72 of bumper 26 (FIG. 5). This pinching effect and the surface friction between cover 26 and frame 10 act to hold protected bumper structure 6 onto backboard structure 2. Protected bumper structure 6 is therefore securely mounted onto backboard structure 2.

Placed around bumper pad 24 in this manner, cover 26 protects the outer surfaces of bumper pad 24 from scratches and abrasions caused by basketball players and basketballs.

The interlock knit material from which cover 26 is made is less susceptible to scratches, tears, scuffs, and discoloration then is the closed cell rubber from which bumper paid 24 is made. If the cover 26 itself becomes damaged, it can easily and inexpensively be replaced. Cover 26 also provides cushioning effect beyond that provided by bumper pad 24 to help prevent injuries to basketball players.

Furthermore, protective cover 26 may be cheaply manufactured in colors matching those of the school or organization that owns backboard being protected. Accordingly, the bumpers may be economically manufactured in one color and customized to match a school's color using the protective cover 26 described herein.

It should be clear that many modifications may be made to the present invention without departing from the spirit thereof. For example, folds 66 and 68 are left at corners 46 and 48 to accommodate corners 74 and 76, respectively. Optionally, slits may be formed part way across cover 26 transverse to the axis thereof at the points where cover 26 coincides with corners 46 and 48. Corners 74 and 76 of backboard structure 2 would penetrate these slits and thus not place undue strain on the material from which cover 26 is made. In similar fashion, pockets may be formed on cover 26 at the points where cover 26 coincides with corners 46 and 48. These pockets would receive corners 74 and 76, thereby relieving excess strain on cover 26.

While the preferred embodiment employs a cylindrically shaped cover 26 made of stretchable material, a tailored cover may be made from non-stretchable material. Such a tailored cover would be designed to conform exactly to the surfaces of bumper pad 24.

In the preferred embodiment, the upper surfaces of ends 62 and 64 of bumper pad 24 were left uncovered. Flaps may optionally be provided on ends 52 and 54 of cover 26 which conform to the exposed surface of ends 62 and 64. A zipper or Velcro (TM) fastening means may be employed to close the flaps on the ends of cover 26.

The present invention may also be easily adapted to a fan or other shaped backboard instead of the rectangular backboard of the preferred embodiment.

Additionally, in certain configurations of the present invention, peripheral steel frame 11 and liner 51 may be omitted.

Accordingly, it is clear that the invention may be embodied in forms other than disclosed above without departing from the spirit or essential characteristics of the invention. The above-described embodiments are therefore to be considered in all respects as illustrative and not restrictive, the scope of the invention being indicated by the appended claims rather than by the foregoing description. All changes which come within the meaning and range of equivalency of the claims are therefore intended to be embraced therein.

What is claimed is:

1. A combination of:

a. a backboard on which a basketball rim is mounted, the backboard having edges on the bottom and sides thereof;

b. a resilient pad having a groove formed thereon, where i. the groove is adapted to receive the bottom and side edges of the backboard, and ii. when the bottom and side edges are so received within the groove the cushioned pad is attached to and covers the bottom and at least partly covers the sides of the backboard; and c. a thin, elongate cover placed over the cushioned pad, the cover being held between the backboard and the cushioned pad when the bottom and side edges of the backboard are received within the groove on the pad, where i. the length of the perimeter of the cross section of the unstretched cover is less than the length of the perimeter of the cross section of the pad, and ii. the cover stretches to conform to the groove when the bottom and side edges are received within the groove.

2. The combination of claim 1, in which the length of the unstretched covering perimeter is determined based on an amount of stretch of the material from which the covering is made.

3. The combination of claim 2, in which:

the pad comprises a bottom portion and two side portions angularly extending therefrom; and the cover comprises a middle portion and two end portions, where the middle portion covers the bottom portion and the end portions cover the side portions.

4. The combination of claim 3, in which the cover is essentially cylindrical in shape.

5. The combination of claim 4, in which:

the length of the cushioned pad is 108 inches;

the cover is made of interlock knit material; and the length of the cover is from 106 to 109 inches.

6. A combination of:

a rectangular backboard structure having top, left, side, right side, and bottom edges;

a rim mounted on the lower center portion of the backboard structure;

a resilient cushioning pad formed of closed cell rubber in a generally U-shaped configuration, with a groove formed on the inner edges of the pad adapted to receive the bottom edge and lower portion of the left and right side edges of the backboard structure; and a generally cylindrical cover made of stretchable material;

whereby the pad is inserted into the cover such that the cover substantially covers the outer surface of the pad;

the bottom left and right side edges of the backboard are inserted into the groove such that the backboard is pinched through the cover between portions of the pad;

the length of the perimeter of the cross section of the unstretched cover is less than the length of the perimeter of the cross section of the pad; and the cover stretches to conform to the groove when the bottom and side edges are received within the groove.

7. A method of cushioning lower edges of a basketball backboard, comprising the steps of:

providing a resilient bumper pad having a groove formed on the inner surface thereof for receiving a bottom edge and lower side edges of the backboard;

providing a stretchable cover having a length substantially the same as the lengths of the outer surfaces of the bumper pad;

inserting the bumper pad into the cover;

inserting the bottom and lower side edges of the backboard into the groove on the bumper pad; and stretching the cover such that the length of the cross-sectional perimeter thereof is substantially the same as the length of the cross-sectional perimeter of the bumper pad.

8. A protected backboard bumper structure for cushioning bottom and lower side edges of a rectangular basketball backboard, comprising:

a generally U-shaped bumper pad having a groove formed on the inner surfaces thereof adapted to receive the bottom and lower side edges of the basketball backboard, and a stretchable cover adapted to fit over the bumper pad, where the length of the perimeter of the cross section of the unstretched cover is less than the length of the perimeter of the cross section of the pad and the cover stretches to conform to the groove when the bottom and side edges are received within the groove; whereby the cover is held between the backboard and the bumper pad when the edges of the backboard are received within the groove on the bumper pad.

9. The protected bumper structure of claim 8, in which the dimensions of the unstretched cover are determined based on (a) the material from which the cover is made and (b) the dimension of the bumper pad.

10. The protected bumper structure of claim 9, in which:

the cover is made of cotton and lycra;

the cover is from 106 to 109 inches in length; and the cover has a cross-sectional perimeter of from 9 to 11 inches.

* * * * *